United States Patent [19]

Yamaguchi et al.

[11] Patent Number: 4,878,873

[45] Date of Patent: Nov. 7, 1989

[54] DOLL TOY

[75] Inventors: Hidehiko Yamaguchi; Kouichi Minami; Nobuo Kobayashi, all of Tokyo, Japan

[73] Assignee: Tomy Kogyo Co., Inc., Tokyo, Japan

[21] Appl. No.: 146,392

[22] Filed: Jan. 21, 1988

[30] Foreign Application Priority Data

Jan. 22, 1987 [JP] Japan ..... 62-7880[U]

[51] Int. Cl.[4] ..... A63H 3/36

[52] U.S. Cl. ..... 446/321; 446/219; 446/484; 446/485; 362/808

[58] Field of Search ..... 446/69, 175, 219, 321, 446/373, 484, 485, 268; 40/577; 362/124, 808, 809

[56] References Cited

U.S. PATENT DOCUMENTS

| | | | |
|---|---|---|---|
| 589,173 | 8/1897 | Henke | 446/210 X |
| 1,080,340 | 12/1913 | Heissenbuttel | 446/485 X |
| 1,349,374 | 8/1920 | Gruenfeld, Jr. | 362/124 X |
| 1,606,354 | 11/1926 | Fillion | 362/124 X |
| 1,728,166 | 9/1929 | Horton | 446/210 X |
| 2,185,708 | 1/1940 | Meyerricks | 362/124 X |
| 2,748,256 | 5/1956 | Moran | 362/808 X |
| 3,049,863 | 8/1962 | Ranney | 362/809 X |
| 3,553,885 | 1/1971 | Tazaki | 446/485 X |
| 3,740,542 | 6/1973 | Brody | 362/124 X |

FOREIGN PATENT DOCUMENTS

| | | | |
|---|---|---|---|
| 2154457A | 9/1985 | United Kingdom | 446/485 UX |

OTHER PUBLICATIONS

Bantamlite, Inc., Literature for "Fairyland Magic Light Up Wand", Mar. 10, 1966.

*Primary Examiner*—Robert A. Hafer
*Assistant Examiner*—Sam Rimell
*Attorney, Agent, or Firm*—Staas & Halsey

[57] ABSTRACT

A doll toy has head and trunk portions which are illuminated to project images thereon by a single interior light source. Illumination of both portions is achieved by making inner cavities of the two portions in communication with each other, so that the light source disposed in the trunk portion and head portions. Projectable images are contained on transparent frames located in both the trunk and head portions.

9 Claims, 2 Drawing Sheets

FIG. 1
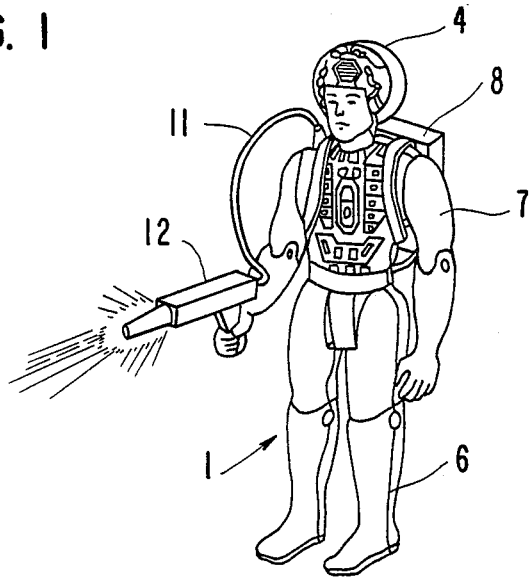
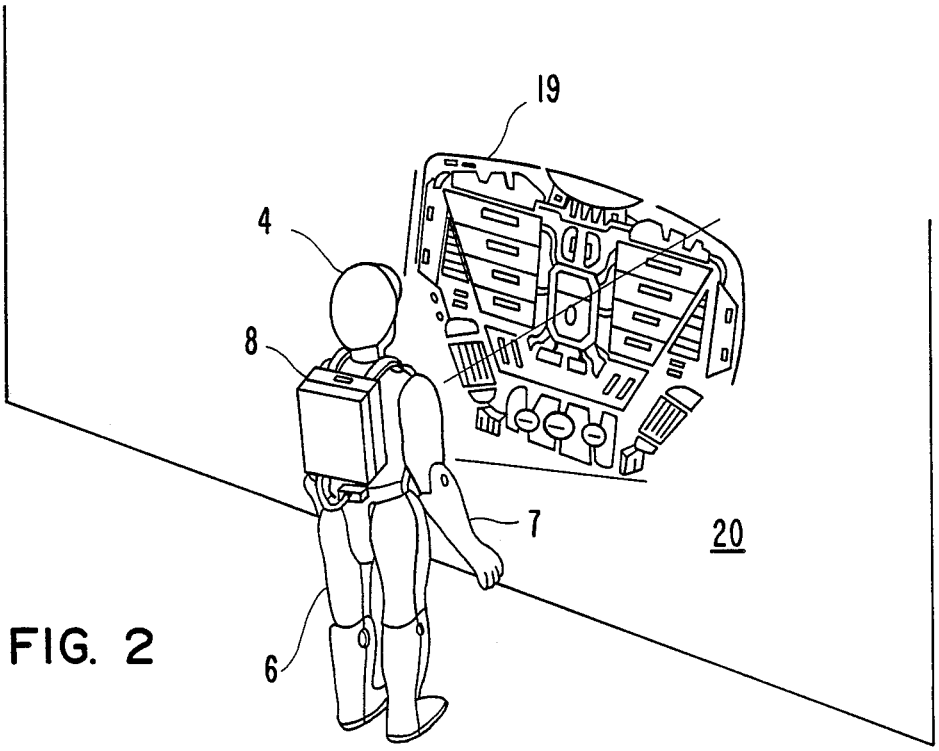
FIG. 2

DOLL TOY

BACKGROUND OF THE INVENTION

1. Field of the Invention

This invention relates to a doll toy having a built-in light source positioned in the body of the doll, wherein light from the light source makes a desired pattern projected on trunk and head members of the doll toy.

2. Description of the Related Art

Conventionally, it has been known to position a light source in the head member of a doll toy, so that light from the light source changes the color of the predetermined portion of the face of the doll toy.

A problem associated with the known devices is that only part of the face of the doll toy is illuminated, resulting in a poor visual effect.

SUMMARY OF THE INVENTION

An object of the present invention is to provide or attain a high quality visual effect which has not been obtained by using known devices.

Another object of the invention is to provide even lighting to a head of a doll toy, thereby producing a good visual effect.

These and other objects of the invention are obtained by providing a doll toy comprising an outer shell body having a head portion and a torso or trunk portion in communication with each other. The shell body is made of a transparent or semi-transparent material and houses a light source in the trunk portion and a "transparent" or projection sheet which is also made of transparent material and carries a desired pattern or image to be projected.

Light from the light source placed in the trunk member projects the desired pattern on the head member and the trunk member of the outer shell body.

BRIEF DESCRIPTION OF THE DRAWINGS

FIG. 1 is a perspective view of the doll toy, illustrating in particular the main body of the preferred embodiment;

FIG. 2 is a perspective view showing an image projected on a wall, using the doll toy of the preferred embodiment of FIG. 1;

DETAILED DESCRIPTION OF THE PREFERRED EMBODIMENTS

Figure 3:
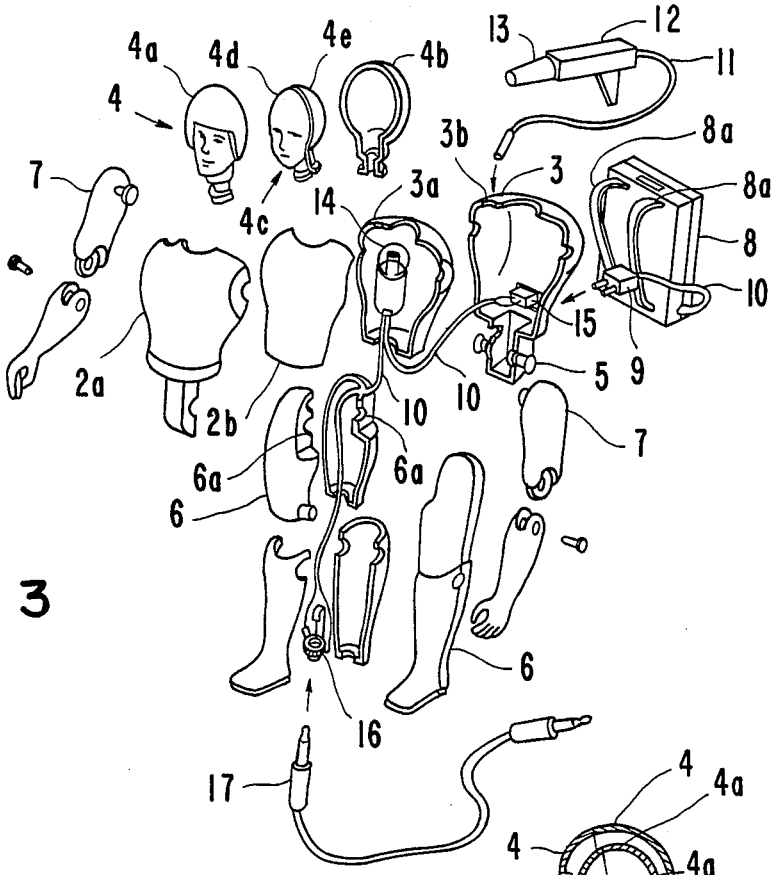
FIG. 3 is a perspective exploded view of the doll toy shown in FIG. 1.
Figure 4:
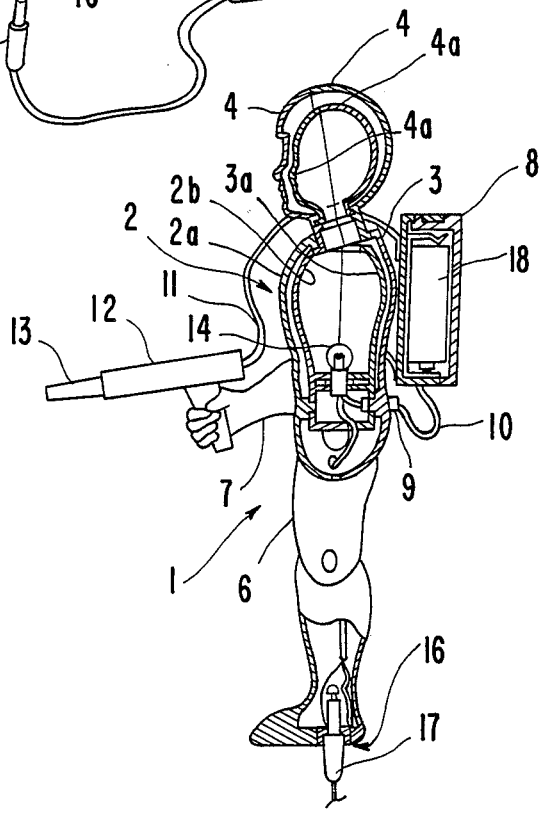
FIG. 4 is a vertical cross-section view of the doll toy shown in FIG. 1.

Referring now to FIGS. 1–4, a doll toy has a main body 1, which includes a head member or portion 4, a trunk member 2, and leg members 6. As shown in FIG. 3, head member 4 is formed by a pair of halves 4*a*, 4*b* and constitute a head portion of an outer shell body, which is divided vertically. These head member halves 4*a*, 4*b* are formed using a semitransparent material. In the head member halves 4*a*, 4*b* a transparent frame 4*c* displays a desired pattern and is made of a transparent material. The transparent frame 4*c* is made of two halves 4*d*, 4*e*.

The trunk member 2 is constructed of a front outer shell body 2*a* and a rear outer shell 3, each of which is made of a semitransparent material. Within the interiors of the front outer shell body 2*a* and the rear outer body 3, transparent frames 2*b* and 3*a* made of a transparent material are positioned. A light source 14 is supported at the lower portion of these transparent frames 2*b*, 3*a*. The interior space of the trunk member 2 in which the light source 14 is supported is in communication with the interior space of the head member 4 in which the transparent frame is positioned. Therefore, only one light source 14 is needed to sufficiently illuminate the space of both the trunk member and the head member.

The power source for powering the light source 14 is a battery 18 contained in the space of a cell box 8 piggybacked on a back of the doll body. A plug 9 is fixed at one end of a power cord 10, the opposite end of which is connected to the cell or battery box 8. The plug 9 is engageable with a jack 15 placed on the back of the trunk member. An additional jack 16 placed at the lower end of the leg member 6 is used when power is supplied from other than the cell box 8 on the back of the doll toy. A plug 17 is engageable with and insertable into the jack 16.

An upper portion of the leg member 6 has a pair of cut-off portions 6*a* formed therein. A through-opening constructed by these cut-off portions 6*a* is fitted to a joint member 5 extruded and formed on a lower end of the shell body 3 so as to rotatably support the leg member.

A model gun 12 is gripped by an arm 7 of the toy doll. By connecting one end of a light transmitting cable 11 into the base of the model gun 12 and the other end into an opening 36 formed on the rear portion of the outer shell body 3, light from the light source 14 can be transmitted to an illuminating member 13 provided at the front end of the model gun 12.

Consequently, when the light source 14 placed in the trunk member of the toy doll is lit, the pattern overlaid on the transparent frames 2*b*, 3*a* and 4*c* is projected onto the head member 4 and the rear outer shell body 3 and the front outer shell body 2 which together constitute the trunk member (see FIG. 1). It is possible to project an image 19 of the pattern on a wall 20 in front of the doll toy (see FIG. 2).

The light generated by the light source placed in the interior of the doll body permits the desired pattern displayed on the transparent frame to be projected onto the head member and the trunk member, attaining a lively doll toy or giving a liveliness to the doll toy, and giving satisfying visual interests to the doll toy.

We claim:

1. A doll toy comprising:

a head member having a first interior space;

a trunk member having a second interior space and being connected to the head member, the first interior space being in communication with the second interior space;

wherein the head member and the trunk member constitute portions of an outer shell body of the doll toy;

frame means which includes a pattern and being disposed within the outer shell body, for projecting a desired pattern onto the outer shell body, the frame means being transparent and hollow; and a light source disposed within the frame means for providing illumination light to project images from the patterned frame means onto the outer shell body, wherein the frame means is a plurality of transparent frames, each made of a transparent material and including a pattern for displaying images.

2. A doll toy as recited in claim 1, wherein the plurality of transparent frames comprise, a head member transparent frame disposed within the head member, and a trunk member transparent frame disposed within the trunk member, the head member transparent frame and the trunk member transparent frame being disposed adjacent to the head member and the trunk member, respectively, to project images from the head member frame and the trunk member frame to the head member and the trunk member.

3. A doll toy as recited in claim 2, further comprising a power source attachably connected to a rearward portion of the trunk member to supply power to the light source.

4. The doll toy as recited in claim 3, further comprising arm and leg members connected to the trunk member.

5. A doll toy as recited in claim 4, further comprising:

a light emitting device connected to an arm member; and an optical cable having one end connected to the light emitting device and the other end connected to the trunk member for transmitting light from an interior of the trunk member to the light emitting device.

6. A doll toy as recited in claim 1, wherein the head member and the trunk member are made of transparent material.

7. A doll toy as recited in claim 1, wherein the head member and trunk member are made of semi-transparent material.

8. A doll toy as recited in claim 1 wherein light source further projects images from the frame meas to walls facing the trunk member.

9. A doll toy comprising:

a head member;

a trunk member connected to the head member and having an interior space in communication with an interior space of the head member;

wherein the head member and the trunk member constitute portions of the outer shell body of the doll toy;

frame means which includes a pattern, disposed within the outer shell body, for displaying a desired pattern which is projectable onto the head member and the trunk member;

a light source disposed within the trunk member for providing illumination light to project images on the frame means onto the head member and trunk member;

a light emitting device connected to an arm member; and an optical cable having one end connected to the light emitting device and the other end connected to the trunk member for transmitting light from the interior of the trunk member to the light emitting device.

* * * * *